United States Patent [19]

Haldemann et al.

[11] Patent Number: 4,536,006

[45] Date of Patent: Aug. 20, 1985

[54] SAFETY BINDING OF A BOOT ON A SKI

[75] Inventors: Gaston Haldemann, Fürigen; François Wirz, Savièse, both of Switzerland

[73] Assignee: Haldemann A.G., Stans, Switzerland

[21] Appl. No.: 458,909

[22] Filed: Jan. 18, 1983

[30] Foreign Application Priority Data

Jan. 27, 1982 [CH] Switzerland ..... 495/82
Jul. 30, 1982 [CH] Switzerland ..... 4618/82

[51] Int. Cl.[3] ..... A63C 9/085; A63C 9/086

[52] U.S. Cl. ..... 280/613; 36/117; 280/624; 280/625; 280/629

[58] Field of Search ..... 280/613, 624, 625, 629, 280/634, 623, 611, 11.3, 620, 635; 36/117, 132, 131

[56] References Cited

U.S. PATENT DOCUMENTS

| | | | |
|---|---|---|---|
| 1,615,032 | 1/1927 | Palmquist | 280/615 |
| 3,613,270 | 10/1971 | Eie | 36/117 |
| 4,063,752 | 12/1977 | Whitaker | 280/623 |
| 4,139,211 | 2/1979 | Salomon | 280/613 |
| 4,143,886 | 3/1979 | Salomon | 280/624 |

FOREIGN PATENT DOCUMENTS

| | | |
|---|---|---|
| 407471 | 6/1923 | Fed. Rep. of Germany . |
| 2643123 | 4/1977 | Fed. Rep. of Germany . |
| 2282823 | 3/1976 | France . |
| 2311567 | 12/1976 | France . |
| 2357270 | 2/1978 | France . |
| 2420358 | 10/1979 | France . |
| 2445730 | 8/1980 | France . |
| 2332773 | 9/1980 | France . |

*Primary Examiner*—Joseph F. Peters, Jr.
*Assistant Examiner*—Joseph G. McCarthy
*Attorney, Agent, or Firm*—Young & Thompson

[57] ABSTRACT

A ski binding comprising two lateral clamps (4, 4') mounted displaceably under the action of a resilient member parallel to the plane of the ski (3) between a closed position in which the clamps coact with the sole of the boot and an open position. These clamps have when viewed from above a forwardly converging shape flaring rearwardly; the portion of each clamp adapted to coact in closed position with a medial portion of the sole of the boot forms a ramp that makes with the plane of the ski an acute angle increasing from the front ($\alpha$) to the rear ($\beta$). These clamps are carried by arms pivotally mounted on the ski behind the clamps. The ski boot (8) adapted to be maintained in operative position on a ski by the above binding comprises a sole (9) whose medial portion (10) has lateral edges forming ramps (11) corresponding to those of the clamps of the binding.

26 Claims, 27 Drawing Figures

FIG. 7A
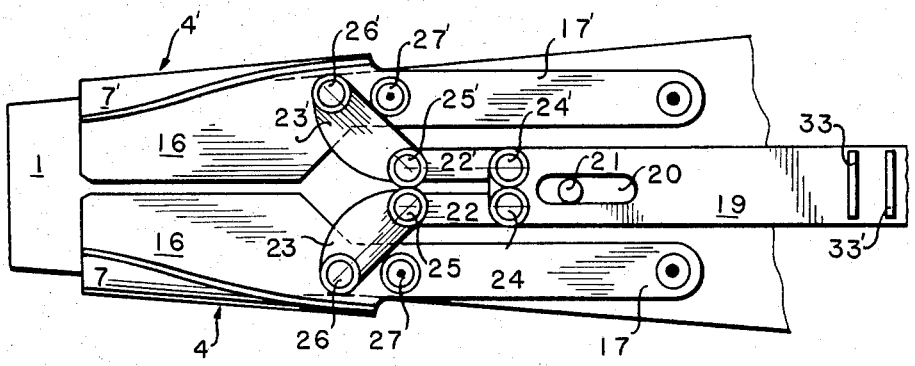
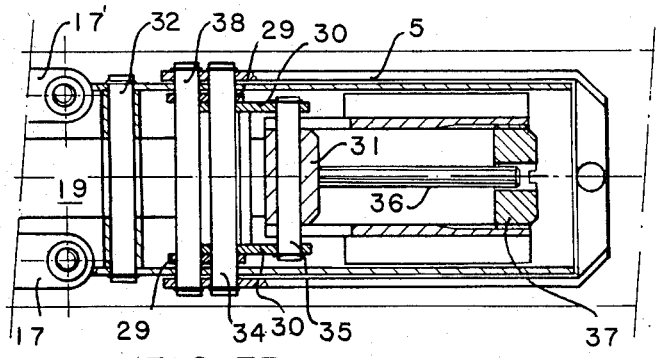
FIG. 7B
FIG. 8
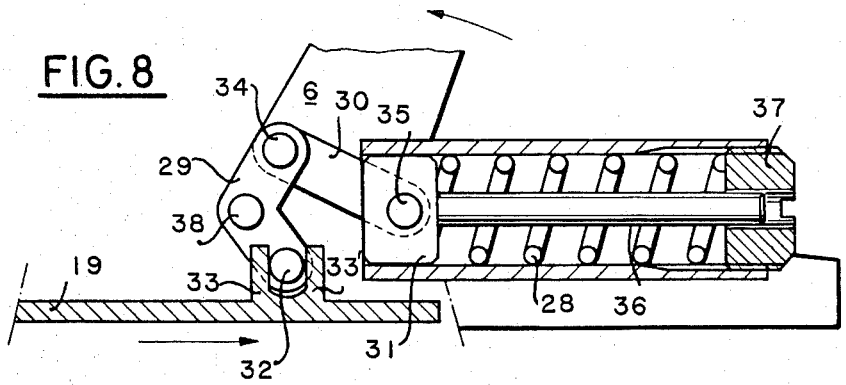

SAFETY BINDING OF A BOOT ON A SKI

The present invention relates to a safety binding of a boot on a ski with lateral clamps, that is, in which two lateral clamps are movably mounted parallel to the plane of the ski, under the influence of a resilient member, between a closed position in which they cooperate with the sole of the boot and an open position in which the latter is completely freed.

The principle of bindings with lateral clamps has been known for a number of years, particularly from French patents Nos. 1,411,638 and 2,021,237, but has not until the present been sufficiently satisfactorily and safely embodied to be successfully commercialized. Certain improvements have been made for example to avoid the need for the user to reset the binding once the latter has been voluntarily opened or in the case of a fall, as described in French patent Nos. 2,332,773 and 2,445,730, or to improve the disengagement of the boot when opening the safety binding, as described in French patent No. 2,420,358.

Nevertheless, the known bindings with lateral clamps all have one or more of the following drawbacks: the possibility of insufficient lateral disengagement from the boot, the latter being hindered by the presence of the clamps even when these are in open position, too great complication of the system and accordingly a non-competitive sales price, the need to use a special plate to fix to the sole of the boot, etc. Finally, all these known bindings use movable members such as wedges, inclined members, etc., which are in frictional contact with each other, which tends to pose more or less long-term problems when wear begins to impede the normal operation of the movable members.

Accordingly, a first object of this invention tending to solve simultaneously all the recited drawbacks, consists in a binding of the type described above and which is characterized by the fact that the clamps are carried by arms pivotally mounted on the ski and have plan views of forwarding converging shape opening rearwardly, and by the fact that the portion of each clamp adapted to coact in closed position with the boot sole provides a ramp forming with the plane of the ski an acute angle that increases from front to rear.

According to a particular embodiment of the invention, each lateral clamp is connected to a longitudinally sliding strip by pivotally interconnected rods, this strip being itself subjected to the action of the resilient member, for example by a spring secured longitudinally on the ski to the rear of the pivot points of the arms carrying the clamps. In this embodiment, the rear end of the strip coacts with one end of a pivotal crank whose other end is connected by a rod pivoted to a piston subjected to the action of the resilient member. The crank in this case has two stable positions corresponding to the respective open and closed positions of the clamps.

Finally, a second object of the present invention consists in a ski boot adapted to be secured to a ski by means of the security binding described above, this boot being characterized by the fact that it comprises a sole whose medial portion has lateral edges of generally conical shape when seen in plan and comprising on each side of the sole a ramp forming with the plane of the latter an acute angle increasing from front to rear, these edges being adapted to cooperate in operative position with the lateral clamps of the binding.

The accompanying drawings show schematically and by way of example several embodiments of the safety binding and of the boot according to the invention.

FIGS. *7a* and *7b* are views from above of the binding in closed position, showing respectively the lateral clamps and the resilient tension member.

FIG. 8 is a longitudinal cross-sectional view of the resilient tension member with the transmission device comprising rods in the position corresponding to that of FIGS. *7a* and *7b*.

Figure 9:
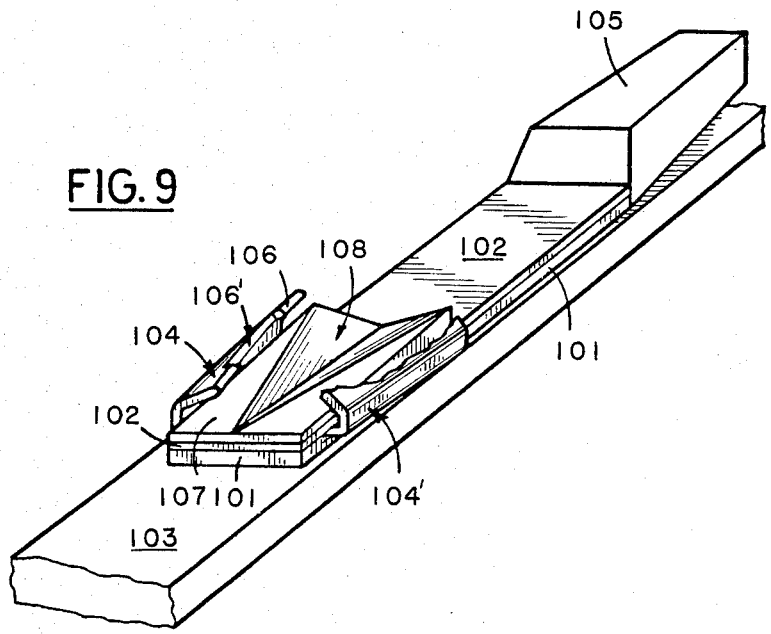

FIG. 9 is a perspective view of the clamps of a second embodiment of the binding, with a first embodiment of the means for centering the sole.

Figure 10:
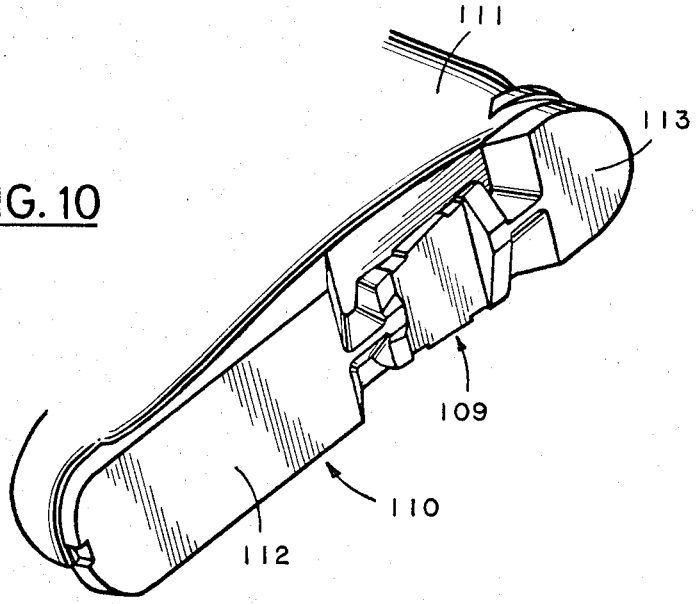

FIG. 10 is a perspective view from below of the sole of a second embodiment of ski boot adapted to coact with the binding of FIG. 9.

Figure 11:
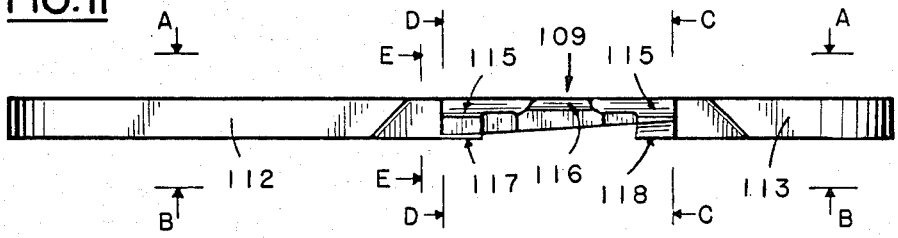

FIG. 11 is a side view of the sole according to FIG. 10.

Figure 12:
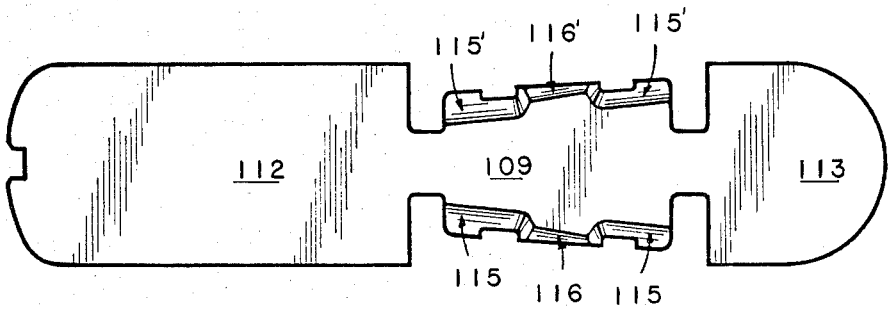
Figure 13:
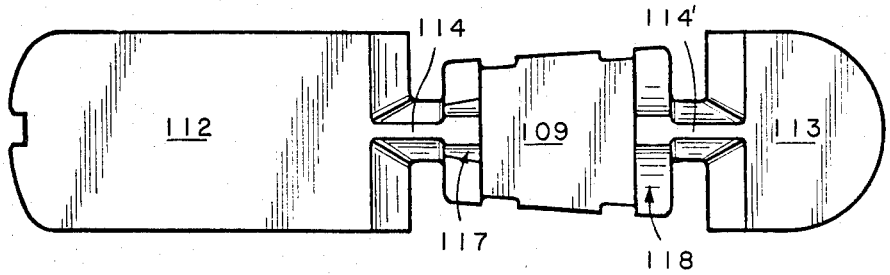

FIGS. 12 and 13 are views respectively from above (AA) and from below (BB) of the sole according to FIG. 11.

Figure 14:
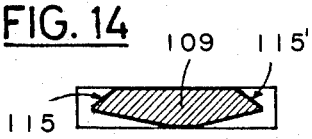
Figure 15:
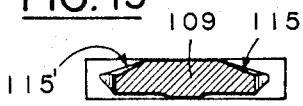
Figure 16:
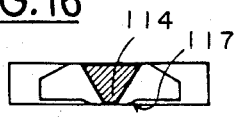

FIGS. 14 to 16 are transverse cross-sectional views of the sole taken on the lines C—C, D—D and E—E, respectively, of FIG. 11.

Figure 17:
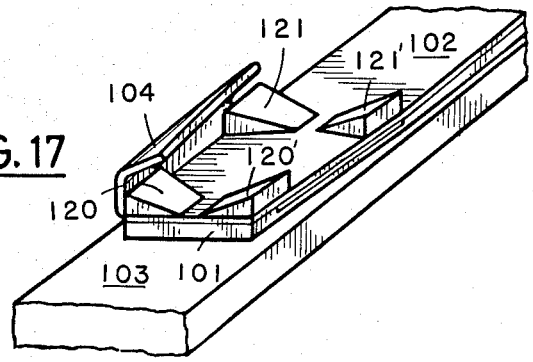

FIG. 17, is a perspective view of the clamps of the second embodiment of the binding, with modification of the centering means for the sole.

Figure 18:
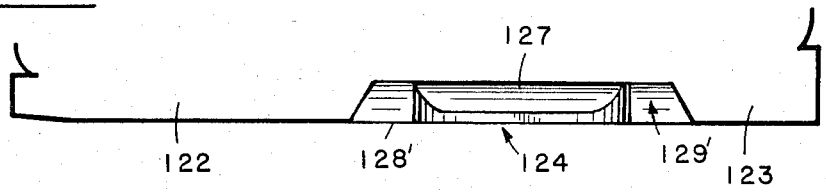
Figure 19:
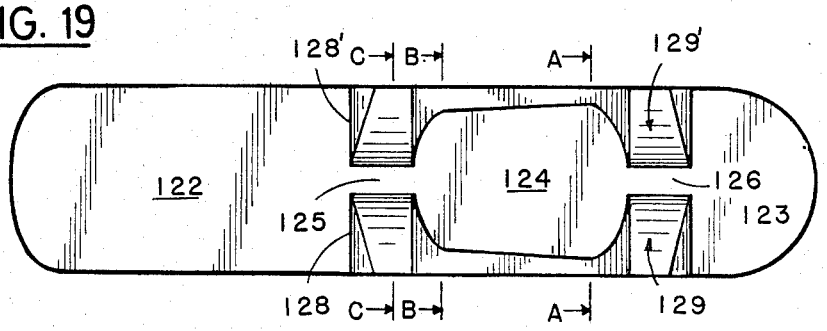

FIGS. 18 and 19 are side and bottom views, respectively, of the ski boot sole adapted to coact with the binding of FIG. 17.

Figure 20:
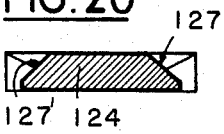
Figure 21:
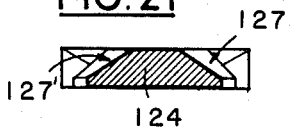
Figure 22:
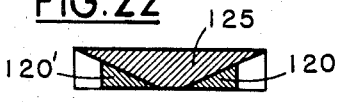

FIGS. 20 to 22 are transverse cross-sectional views of the sole taken on the lines A—A, B—B and C—C, respectively, of FIG. 19.

Figure 23:
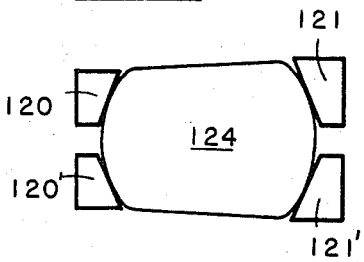

FIG. 23 is a schematic view showing the position of the medial portion of the sole according to FIGS. 18 and 19 on the centering blocks of the binding according to FIG. 17.

Figure 24:
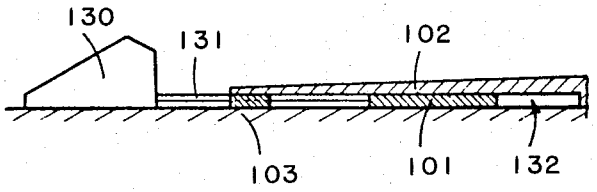

FIGS. 24. and 25 are side and plan views, respectively, of an adjustable stop completing the second embodiment of the binding.

Figure 26:
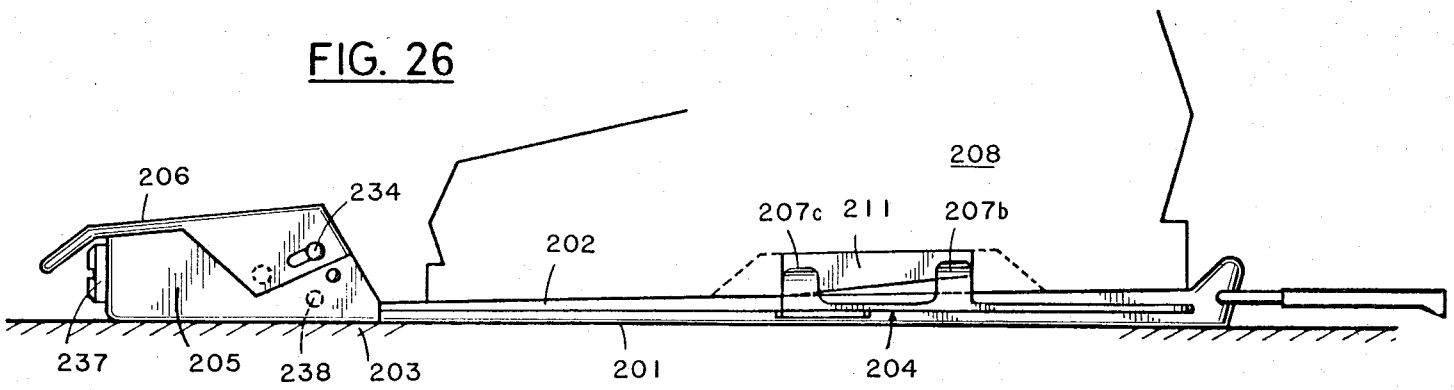

FIG. 26 is a side view of a third embodiment of the binding according to the invention.

Referring first to FIGS. 1 to 4, a first embodiment of the safety binding comprises two base plates 1, 2 secured to a ski 3 and between which are mounted two lateral clamps 4, 4' laterally displaceable under the influence of a resilient member contained in a housing 5 secured to the ski, the resilient member being adapted to be actuated by a lever 6. Each clamp 4, 4' comprises a portion 7, 7' extending upwardly and inwardly and forming with the plane of the ski an acute angle which increases from front to rear so as to confer on this portion a slightly helical nature. The minimum angle $\alpha$ may be of the order of about 30°, while the minimum angle $\beta$ may be about 60°.

Figure 1:
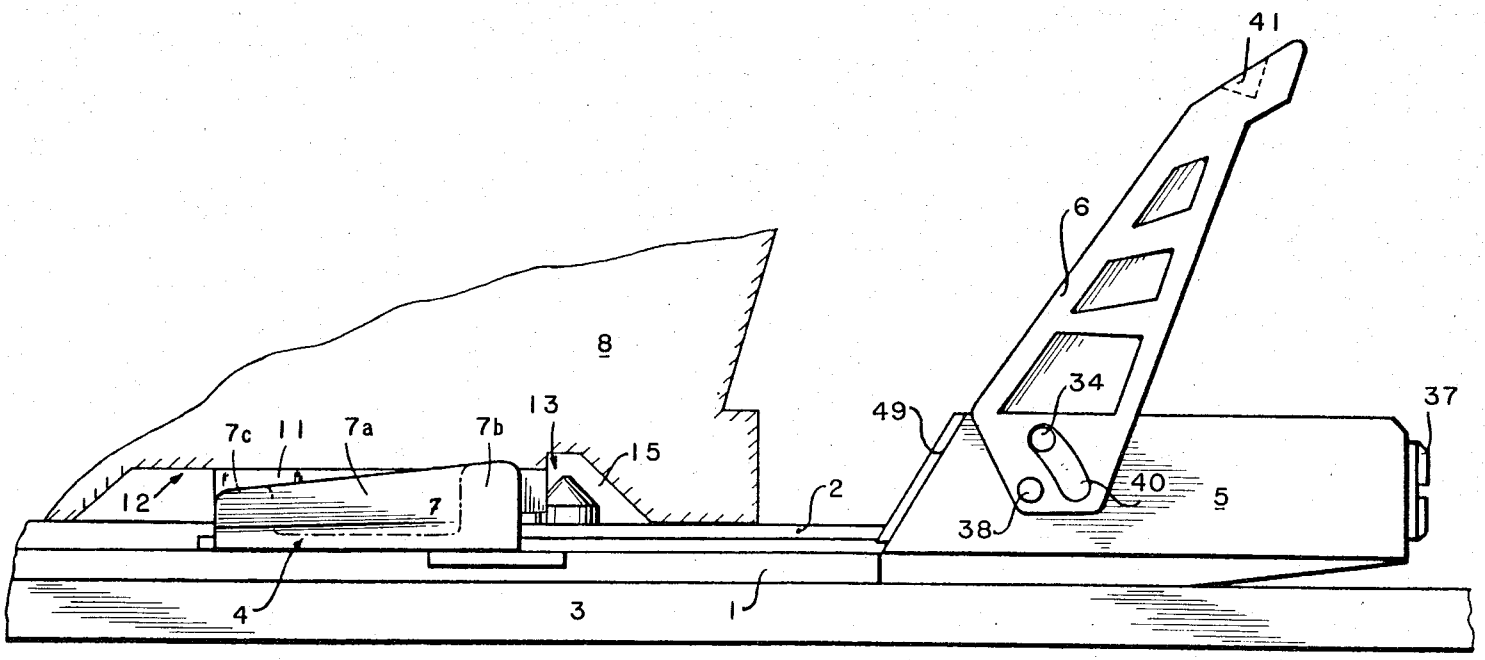
FIG. 1 is an overall side view of a first embodiment of the binding in closed position on a ski boot which is partially shown.

According to a modification shown in phantom lines in FIG. 1, each clamp 4 may have a hollowed out mid-portion 7*a* leaving only two external portions 7*b*, 7*c* somewhat forming claws.

Figure 3:
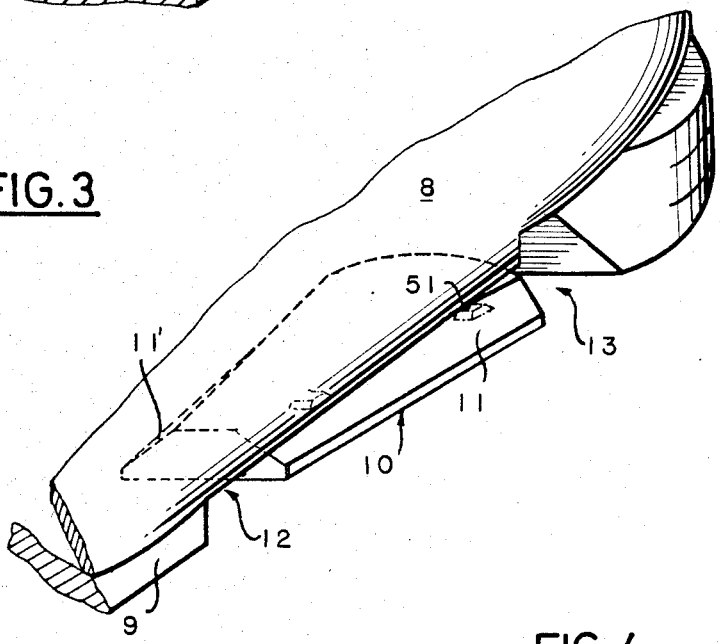
FIGS. 3 and 4 are views respectively in perspective and from below of a first embodiment of the sole of the ski boot.
Figure 4:
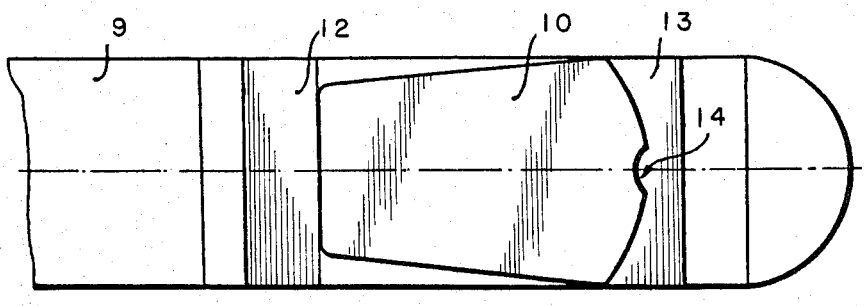

The first embodiment of ski boot 8 shown partially in FIGS. 3 and 4 comprises a sole 9, whose medial portion 10 has lateral edges 11, 11′ forming on each side of the sole a ramp forming with the plane of the latter an acute angle increasing from front to rear and conferring on it a shape corresponding to that of the space comprised between the clamps 4, 4′ in closed position. Thus, in the operative position shown in FIG. 1, the clamps 4, 4′ exactly mate with lateral ramps 11, 11′ of the medial portion 10 of the sole 9 of the boot 8.

Figure 5:
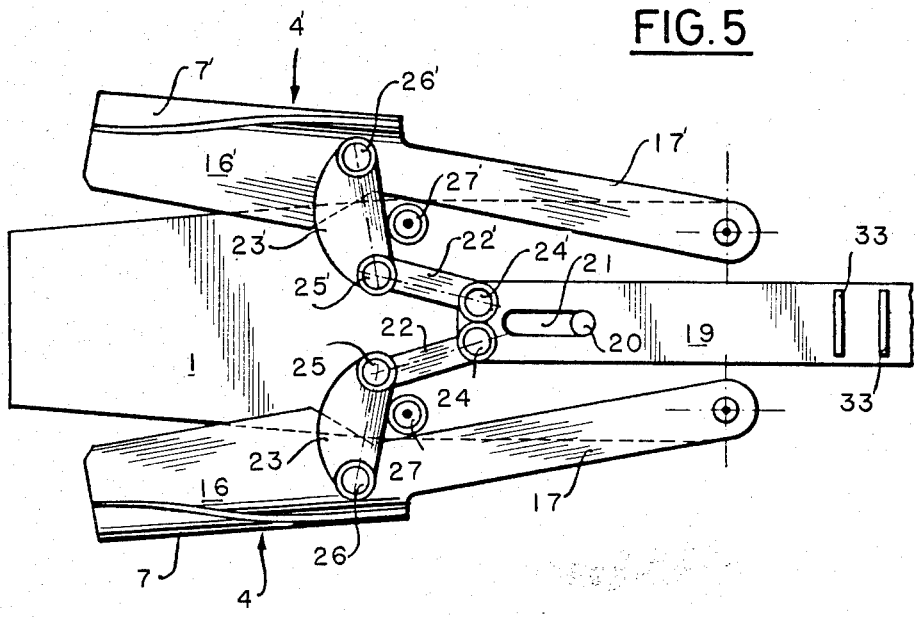
FIG. 5 is a view from above of the lateral clamps of the binding according to FIG. 1 in open position with their system of actuating rods.

The length d of medial portion 10 (FIG. 4) is less than the minimum distance d′ between the clamps 4, 4′ in open position (FIG. 5).

Moreover, to ensure easy lateral disengagement of the boot 8 when the clamps are in open position, either in the case of a fall, or else voluntarily, the sole 9 also has two transverse channels 12, 13 respectively delimiting the front and rear of medial portion 10. The rear end of this medial portion 10 also has an indentation 14, located on the longitudinal axis of the sole and which is adapted to coact, in the operative position, with a centering cone 15 secured to the upper plate 2 of the binding, behind the lateral clamps 4, 4′ and on the medial longitudinal axis of the ski.

Figure 2:
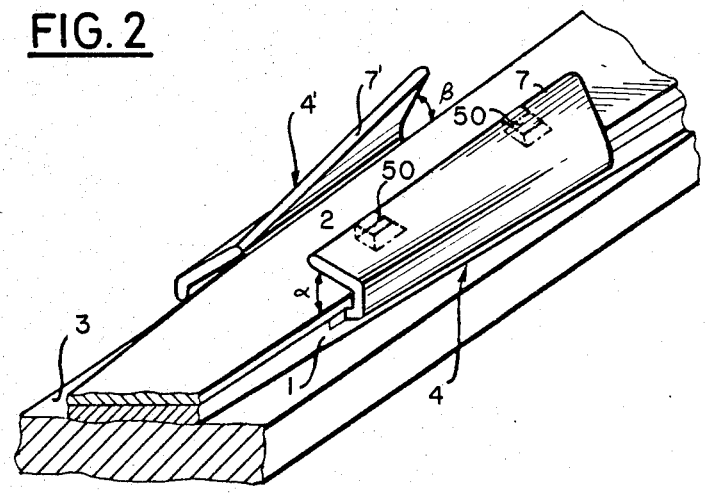
FIG. 2 is a perspective view showing the shape of two lateral clamps of the binding according to FIG. 1.

According to a modification shown in phantom lines in FIGS. 2 and 3, the upper edge of the portion 7 of each clamp 4 may have two open notches 50, of approximately square or rectangular shape, and whose lateral internal side walls are inclined, with a slope of about 45°, from the exterior toward the interior. These notches 50 are adapted to cooperate in operative position with cleats 51 whose shape corresponds to that of the notches. In this modification, the torsional force in case of a fall is better transmitted to the clamps, and moreover the centering of the boot is improved.

The ski boot sole adapted to be fixed by means of the binding according to the invention may be of one-piece construction with its various characteristics as described above.

An example of an actuating device for the lateral clamps 4, 4′ will now be described with reference to FIGS. 5 to 8. The clamps 4, 4′ whose shape in plan view is, forwardly convering and flowing to the rear, comprise also helical portions 7, 7′ coacting in operative position with the boot sole, the horizontal portions 16, 16′ constituting prolongations of two arms 17, 17′. These arms 17, 17′ are pivotally mounted on the plate 1 of the binding about vertical axes 18, 18′, whereby the clamps 4, 4′ move by pivoting of the arms 17, 17′ parallel to the ski surface between an open position (FIGS. 5 and 6) and a closed position (FIGS. 7*a*, 7*b* and 8), the helical portions 7, 7′ of the clamps 4, 4′ gripping in this closed position the likewise helical edges of the medial portion of the sole of the boot.

As shown in FIGS. 5 and 7*a*, a strip 19 is longitudinally slidably mounted between the two arms 17, 17′ bearing the clamps 4, 4′, the sliding movement being centered by a pin 20 fixed to plate 1 coacting with a longitudinal slot provided in this strip 19. The forward end of this strip 19 is connected to the lateral clamps 4, 4′, more particularly to their horizontal portions 16, 16′, by means of two pairs of rods 22, 23; 22′, 23′. Each pair comprises a first rod 22, 22′ whose end is pivoted to the end of the strip 19, the other end of this rod 22, 22′ being itself pivoted to a second rod 23, 23′, which is pivoted on the horizontal portion 16, 16′ of the clamp 4, 4′. The various pivots are provided by respective vertical pivotal axles 24, 24′; 25, 25′; 26, 26′. Finally, the outer edge of each second rod 23, 23′ is in contact with a roller 27, 27′ secured to plate 1 and provided with a ring that turns in a manner to guide and promote movement from one position to the other.

Figure 6:
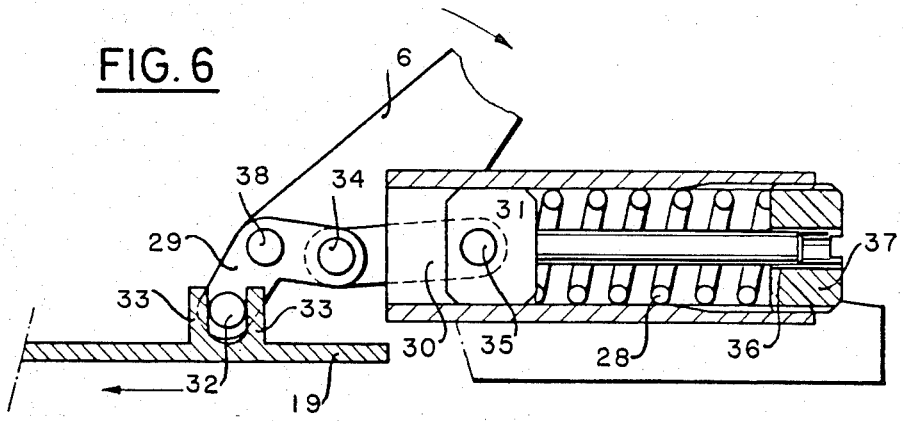
FIG. 6 is a longitudinal cross-sectional view of the resilient tension member with the transmission device comprising rods in the position corresponding to that of FIG. 5.

As shown in FIGS. 6, 7*b* and 8, the strip 19 is connected by its rear end to a resilient member here comprised by a spring 28 fixedly mounted with respect to the ski, longitudinally behind said strip 19. This connection is provided by a crank 29 whose one end coacts with strip 19 and whose other end is connected by a rod 30 to a piston 31 fixed to spring 28. More particularly, and as shown in FIG. 7*b*, a transverse axle 32, secured between the corresponding ends of the two cranks 29, 29′ disposed in side-by-side parallelism to each other, coacts with the channel formed between two transverse projections 33, 33′ provided on the rear end of strip 19. In the same way, each of these two cranks 29, 29′ is connected to piston 31 by a rod 30, 30′, a transverse axle 34 being secured to the pivot between the cranks 29, 29′ and the rods 30, 30′ and a transverse axle 35 whose ends serve to articulate the rods 30, 30′ coacts with said piston 31. A guide rod 36 is moreover secured longitudinally by one of its ends to the piston 31, and passes through spring 28 and is freely rotatably received at its other end in an adjustment nut 37 adapted to adjust the resilient force of the spring 28 by screwing or unscrewing the latter in the wall of the housing 5. Finally, the transverse axle 38 connecting the elbow portions of the two parallel cranks 29, 29′ is pivoted in the lateral wall of the casing 5.

The connection mechanism between the strip 19 and the resilient member 28 permits, thanks to the presence of cranks 29, 29′, defining two stable positions corresponding to the respective open and closed positions (FIGS. 6 and 8) of the lateral clamps 4, 4′.

As shown in FIG. 1, the actuating lever 6 is pivotally mounted about the ends of the axle 38 on the exterior of casing 5, and is pierced on each side by a slightly arcuate opening 40 in which move the ends of transverse axle 34 which is the pivot between the two cranks 29, 29′ and the two rods 30, 30′.

The operation of the safety binding as has been described with reference to FIGS. 1 to 8 is the following.

The securement of the boot 8 on the ski 3 is achieved by placing the former between the open lateral clamps 4, 4′, such that the boot is centered thanks to centering cone 15 coacting with indentation 14 corresponding substantially to the rear of the medial portion 10 of sole 9. It then suffices to pull on tension lever 6 thereby to invert the position of the cranks 29, 29′ to move rearwardly the strip 19 (see FIG. 8) thereby to close clamps 4, 4′ on the medial portion 10 of the sole 9 of the boot 8.

The arrangement of the connection of strip 19 to resilient means 28 by a crank system permitting the movement of the bearing axis of the rod connected to said resilient member, provides a lever arm which changes gradually, thus progressively decreasing the moment of force necessary to pass from the open position to the closed position and vice versa. The opening or closing of the clamps is thus automatically effected immediately after passing the equilibrium point of the crank (reversal point). It will be seen that the spring 28 is less compressed in the operative position (FIG. 8) than in the open position (FIG. 6), and accordingly less mechanically stressed, which tends to improve its longevity.

Moreover, the system of rods 22, 22'; 23, 23' to provide the connection between the forward end of strip 19 and clamps 4, 4' permits maximum opening of the latter for a very small longitudinal movement of strip 19 and thus of spring 28. This is important to permit complete disengagement of the boot when the clamps are in open position, either by deliberate manipulation of lever 6 by lowering it, for example by pushing the point of the ski pole into recess 41 provided for this purpose at the upper end of lever 6 and pushing downwardly on the latter, or because of a fall that actuates the safety system. Indeed, the length of the medial portion 10 of the sole 9 being less than the minimum distance between the clamps 4, 4' in the open position, the boot 8 may enjoy a rotation of 90° to each side of the ski above the clamps 4, 4' thanks to the presence of the transverse channels 12, 13 forwardly and rearwardly delimiting this medial portion 10. Thus is remedied one of the most serious drawbacks of safety bindings with lateral clamps, the disengagement of the boot being ensured in no matter what position.

Thus, the use of articulated rods permits achieving a longer lifetime for the device, friction being substantially reduced with respect to known systems.

Finally, and above all, the forwardly convering shape viewed from above of clamps 4, 4' combined with the presence of ramps of variable angle from front to rear permits controlling effectively and simultaneously the lateral torsional forces and the forward and rearward forces of a fall, which is not the case with known devices of the same type. This result is even more improved by the presence of two open notches provided in the upper edge of each clamp and cleats of corresponding form on the medial portion of the boot sole, as in a previously described modification. Moreover, by virtue of the presence of a single centering element 15 cooperating with an indentation that opens to the rear of the medial portion 10 of the sole 9, the boot 8 may as needed, that is to say in case of an abrupt forward shock due for example to frontal impact with a hidden obstacle, directly disengage slidably to the front.

The second embodiment of binding according to the invention shown in FIG. 9 comprises two base plates 101, 102 secured to a ski 103 and between which are mounted two lateral clamps 104, 104' laterally displaceable under the action of a resilient member contained in a casing 105 secured to the ski, the resilient member being adapted to be actuated for example by a lever (not shown). Each clamp 104, 104' comprises a portion 106 extending upwardly and inwardly and forming with the plane of the ski an acute angle which increases from front to rear so as to give to this portion a slightly helical shape. The minimum angle (at the front) may be of the order of about 30°, while the maximum angle (toward the rear) may be of the order of about 60°.

The actuating device (not shown) of the lateral clamps 104, 104' may be, for example, the same as that described previously with respect to the first embodiment of the invention.

Moreover, between lateral clamps 104, 104' is disposed a centering member constituted by a small plate 107 having a tapered impression whose point is forwardly directed of the ski 103 and with which is adapted to coact, in the operative position, the medial portion 109 of sole 110 of a second embodiment of ski boot 111 according to the invention adapted to coact with the above-described safety binding.

This sole 110 shown more particularly in FIGS. 11 to 16, may be of one-piece construction in suitable plastic material and comprises three distinct interconnected portions, namely a forward portion 112, a medial portion 109 and a heel 113, the connection between the three portions consisting of ribs 114, 114'. One or the other of these portions may of course equally be simply provided on the lower surface of the boot.

The medial portion 109 of sole 110 has upper lateral edges 115, 115' forming on each side of each medial portion 109 an upwardly inwardly directed ramp. This ramp forms with the plane of the sole an angle increasing from front to rear and corresponding on each side to the shape of clamps 104, 104' of the binding (see FIGS. 11, 12, 14 and 15). Moreover, each ramp 115, 115' has a projecting portion 116, 116' adapted to coact, in the operative position, with a recess 106 of corresponding shape provided in the upper edge of the helical portion 106 of clamps 104, 104'.

On the other hand, as shown in FIGS. 11 and 13, the medial portion 109 of sole 110 has two tapered centering portions 117, 118 respectively at the forward and rear ends of this medial portion 109. The angle of each portion 117, 118 corresponds to the respective corresponding angles of the tapered impression 108 of small plate 107 of the safety binding, when the medial portion 109 of the sole 110 of ski boot 11 is in operative position between the clamps 104, 104' of said binding.

Thus, in the operative position, the ski boot 111 being disposed longitudinally on ski 103, the medial portion 109 of sole 110 is gripped between clamps 104, 104' of the binding, the closure device of the latter having been actuated. In this position the clamps 104, 104' grip the edges 115, 116, 115', 116' of said medial portion 109 while the tapered portions 117, 118 of the latter coact with the tapered impression 108 of the small plate 107 of said binding.

The operation of this binding in case the skier falls is the same as that previously described with reference to the first embodiment. Moreover, the presence of the tapered impression and of the two centering cones of the sole permit initiating more easily the opening movement of the clamps, and above all promote upward disengagement of the boot, without risking that the latter will catch on the clamps of the binding. Complete reliability not only for the opening of the clamps but also for the complete disengagement of the boot is thus ensured.

A modification of the second embodiment of the binding according to the invention, shown in FIG. 17, is distinguished from the latter in that the small plate with the tapered impression is replaced by four centering blocks 120, 121, 120, 121', secured on the upper face of the base plate 102 of the binding of which only one lateral clamp 104 is shown. Each block 120, 121, 120' and 121' has an upper surface serving as a ramp, the slope of each ramp being on the one hand inclined inwardly toward the upper surface of the base plate 102, and on the other hand slightly inclined rearwardly downwardly for the forward blocks 120, 120' and forwardly downwardly for the rear blocks 121, 121'.

The modification shown in FIG. 17 is adapted to coact with a ski boot sole as illustrated in FIGS. 18 and 19, and which comprises three portions, respectively, a forward portion 122, a heel 123 and a medial portion 124. Preferably, this sole is of one-piece plastic construction, the three constitutive portions being interconnected by conical portions 125, 126.

The medial portion 124 of the sole has lateral edges 127, 127′ forming on each side of this portion an inwardly upwardly directed ramp. This ramp forms with the plane of the sole an angle that increases from front to rear and corresponds on each side to the shape of clamps 104, 104′ of the binding (see the cross sections of FIGS. 20 and 21).

Moreover, as previously indicated, the medial portion 124 is delimited forwardly and rearwardly by two transverse tapered portions 125, 126 whose surfaces 128, 129, 128′, 129′ upwardly outwardly inclined from the center of the sole correspond to the upper surfaces of centering blocks 120, 121, 120′, 121′ with which they are adapted to coact in the operative position (see FIG. 22).

Thus, in the operative position, the lateral edges 127, 127′ of the medial portion 124 of the sole are gripped by lateral clamps 104, 104′ of the binding, and the surfaces 128, 129, 128′, 129′ of the transvers tapered portions 125, 126 coact with the respective centering blocks 120, 121, 120′, 121′ of the binding.

The operation of this modification is comparable to that of the first one previously described. However, in this case, the components of centering forces are substantially greater, given that the coacting transverse tapered portions—tapered portions of the sole and centering blocks of the binding—are disposed outside the medial portion of the sole serving for the gripping as such by the lateral clamps, and no longer below as previously described (see the diagram of FIG. 23).

Moreover, the angles are greater and the upward disengagement of the boot during a fall under torsion is substantially facilitated. Safety is thus even more, increased. Finally, the presence of tapered portion forwardly and rearwardly of the medial portion of the sole permits obtaining front-to-rear centering which is not present in the preceding embodiment. Preferably, the medial portion of the sole of the boot according to the invention, adapted to be gripped by lateral clamps of the binding, has a length less than the minimum distance between these clamps in the open position, so as to permit complete disengagement of the boot even when the latter is perpendicular to the axis of the ski.

Figure 25:
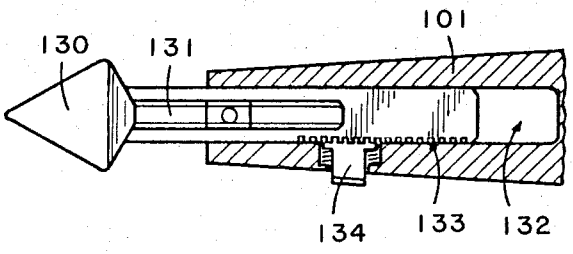

FIGS. 24 and 25 show an adjustable stop adapted to be disposed in front of the clamps (not shown) of the second embodiment of the binding according to the invention. This adjustable stop comprises a block 130 secured to the forward end of a strip 131 slidably longitudinally mounted in an axial opening 132 provided between two base plates 101, 102 of the binding. This strip 131 is provided with teeth 133 adapted to coact with a screw member 134 actuable from the outside so as to set the longitudinal position of the adjustable stop. Thus, this stop has on the one hand the advantage of making it easier for the skier to put on the binding by determining the forward position against which should be placed the forward end of the sole of the boot and permits on the other hand, thanks to the external aerodynamic shape of block 130, to deflect the snow to the sides and avoid accumulation of the latter against the toe of the boot.

Finally, FIG. 26 shows a third embodiment of the binding according to the invention, in which the elastic member contained in the casing 205 secured to the ski 203 and controlling opening and closing of the clamps 204 and having helical portions 207*b*, 207*c* is disposed forwardly of the latter, that is to say forwardly of the toe of the boot of ski 208. As to the rest, the operation of this embodiment is the same as that described with respect to the first embodiment of binding according to the invention. The crank, whose axles 234, 238 are reversed with respect to the first embodiment, is actuated by lever 206 and acts on the arms (not shown) pivoted between the base plates 201, 202 forward of the clamps 204*b*, 204*c* and carrying the same. As before, the clamps 204*b*, 204*c* coact by gripping in the operative position a ramp 211 which comprises the medial portion of the sole of the ski boot 208.

The embodiments of the invention in which an exclusive property or privilege is claimed are defined as follows:

1. Safety binding for a boot on a ski comprising two lateral clamps movably mounted under the influence of a resilient member parallel to the plane of the ski between a closed position in which these clamps coact with the sole of the boot and an open position, characterized by the fact that the clamps are carried by arms pivotally mounted on the ski, said clamps having when seen from above a forwardly converging shape opening rearwardly, and by the fact that the portion of each clamp adapted to coact in closed position with the sole of the boot comprises a ramp forming with the plane of the ski an acute angle that increases from front to rear.

2. Binding according to claim 1, characterized by the fact that each clamp is connected to a longitudinally sliding strip by pivotally interconnected rods and by the fact that the strip is subjected to the action of a resilient member.

3. Binding according to claim 2, characterized by the fact that the rear end of the strip coacts with an end of a crank whose other end is connected by a rod to a piston subjected to the action of the resilient member.

4. Binding according to claim 3, characterized by the fact that a manipulable lever is secured to said crank and by the fact that the latter has two stable positions corresponding to the open and closed positions of the clamps.

5. Binding according to claim 1, characterized by the fact that a medial portion of each clamp is recessed.

6. Binding according to claim 1, characterized by the fact that the upper edge of each clamp has at least one hollow whose internal walls flare from the exterior toward the interior of the clamp, each hollow being adapted to coact in operative position with cleats of corresponding form on the sole of the boot.

7. Binding according to claim 1, characterized by the fact that it comprises at least a centering member for the sole of the boot.

8. Binding according to claim 7, characterized by the fact that the centering member is secured projecting on the medial longitudinal axis of the upper surface of the binding, behind the lateral clamps, this member being adapted to coact in operative position with a recess on the sole of the boot.

9. Binding according to claim 7, characterized by the fact that the centering member of the sole of the boot is disposed between the clamps.

10. Binding according to claim 9, characterized by the fact that the centering member is constituted by a small plate having an impression of tapered form flaring from front to rear and from bottom to top.

11. Binding according to claim 9, characterized by the fact that the centering member comprises four blocks disposed in lateral pairs so as to define a central space adapted to receive a medial portion of the sole of the boot.

12. Binding according to claim 11, characterized by the fact that each centering block has a downwardly inwardly inclined surface, and by the fact that the inclined surface of the forward blocks is also downwardly rearwardly inclined and that that of the rear blocks is also forwardly downwardly inclined.

13. Binding according to claim 1, characterized by the fact that it comprises a forward stop whose position is longitudinally adjustable.

14. Ski boot adapted to be secured on a ski by means of the safety binding according to claim 1, characterized by the fact that it comprises a sole whose medial portion has lateral edges comprising on each side of the sole a ramp which forms with the plane of the sole an acute angle increasing from front to rear, these edges being adapted to coact in operative position with the lateral clamps of the binding.

15. Boot according to claim 14, characterized by the fact that the length of said medial portion is less than the minimum distance between the clamps in open position.

16. Boot according to claim 14, characterized by the fact that said medial portion is delimited forwardly and rearwardly by transverse channels.

17. Boot according to claim 14, characterized by the fact that the rear end of said medial portion has on the medial longitudinal axis a rearwardly opening recess adapted to coact in operative position with a centering member of the binding.

18. Boot according to claim 14, characterized by the fact that said medial portion is provided laterally with at least one cleat adapted to coact in operative position with a said clamp.

19. Boot according to claim 14, characterized by the fact that said medial portion has at least one formation adapted to coact with said centering member of the binding.

20. Ski boot according to claim 19, characterized by the fact that the medial portion has at its respective front and rear ends tapered transverse portions adapted to coact in operative, position with a tapered impression of a centering member comprising a small plate, so as to ensure lateral centering of the boot.

21. Boot according to claim 20, characterized by the fact that the respective angles of the tapered portions of the medial portion, of the sole are equal to the corresponding angles of the tapered centering impression when said medial portion is in operative position gripped between the lateral clamps of the binding.

22. Boot according to claim 19, characterized by the fact that the medial portion is exteriorly bounded forwardly and rearwardly by tapered transverse portions adapted to coact in operative position with centering blocks of the binding.

23. Boot according to claim 22, characterized by the fact that each lateral surface of the tapered portions is inclined on the one hand downwardly inwardly, and on the other hand downwardly rearwardly for the forward tapered portion and downwardly forwardly for the rear tapered portion.

24. Boot according to claim 22, characterized by the fact that the length of the medial portion corresponds to the shortest longitudinal distance between the respective forward and rear centering blocks.

25. Boot according to claim 14, characterized by the fact tht the sole is of one-piece construction.

26. Boot according to claim 14, characterized by the fact that the medial portion of the sole widens toward the lower surface of the sole.

* * * * *